US005127805A

United States Patent [19]

Fallis et al.

[11] Patent Number: 5,127,805

[45] Date of Patent: Jul. 7, 1992

[54] PUMP WITH REVERSE FLOW CAPABILITY AND SYSTEM

[75] Inventors: Robert E. Fallis, Milford; Mark A. Brooks, Sterling Heights; Gary L. Casey, Troy, all of Mich.

[73] Assignee: Allied-Signal Inc., Morris Township, Morris County, N.J.

[21] Appl. No.: 742,444

[22] Filed: Aug. 5, 1991

Related U.S. Application Data

[63] Continuation-in-part of Ser. No. 622,693, Dec. 5, 1990, abandoned.

[51] Int. Cl.[5] ..... F04B 1/04; F01B 1/06

[52] U.S. Cl. ..... 417/273; 417/462; 91/491; 91/498; 91/482

[58] Field of Search ..... 417/273, 498, 482, 237; 91/462, 491

[56] References Cited

U.S. PATENT DOCUMENTS 3,273,511 9/1966 Eickmann ..... 417/273

4,171,732 10/1979 Pinson ..... 91/491

4,605,359 8/1986 Suzuki ..... 417/273

*Primary Examiner*—Richard A. Bertsch

*Assistant Examiner*—Peter Korytnyk

*Attorney, Agent, or Firm*—Markell Seitzman

[57] ABSTRACT

A reversible flow pump (12) comprising: a first port (16) and a second port (20); a rotor (60) comprising a plurality of pump elements (74–80) movable through a fill mode and a discharge mode, a pump chamber (140) associated with each pump element (74) which are respectively filled and discharged; a ported shaft (30) rotatable between a first position and a second position, for carrying fluid to and from the various pump chambers (140), such that when in the first position fluid received at the first port (16) is communicated to fill each pump chamber (140) during the fill mode, at least a portion of such fluid is discharged therefrom and communicated to the second port (20), and wherein in the second position fluid flow is reversed. A brake system incorporating the pump is also disclosed.

18 Claims, 5 Drawing Sheets

FIG. 4
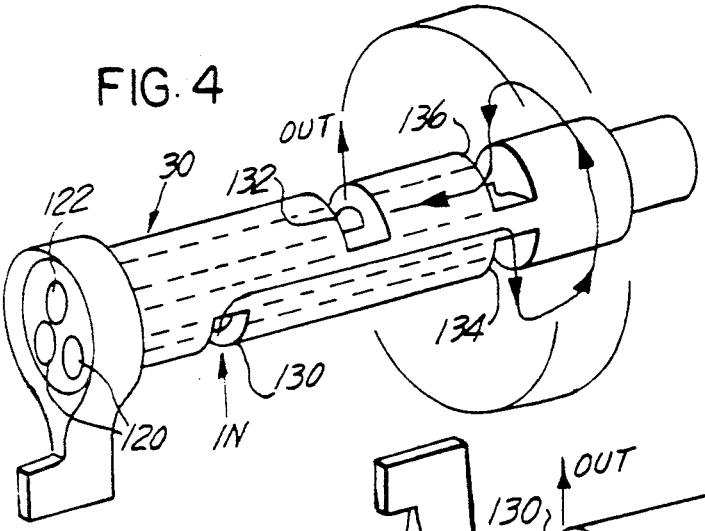
FIG. 5
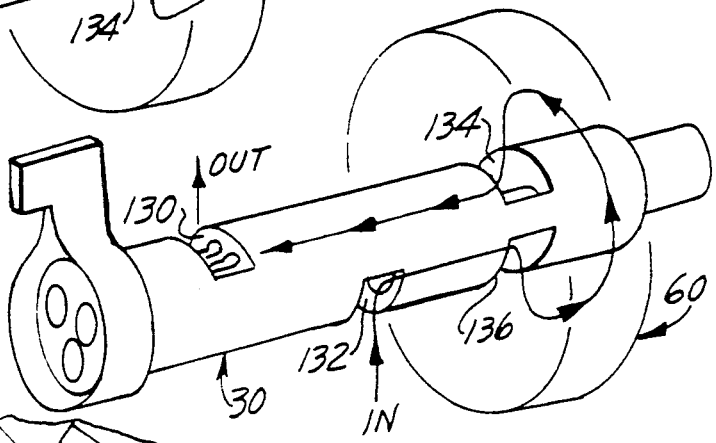
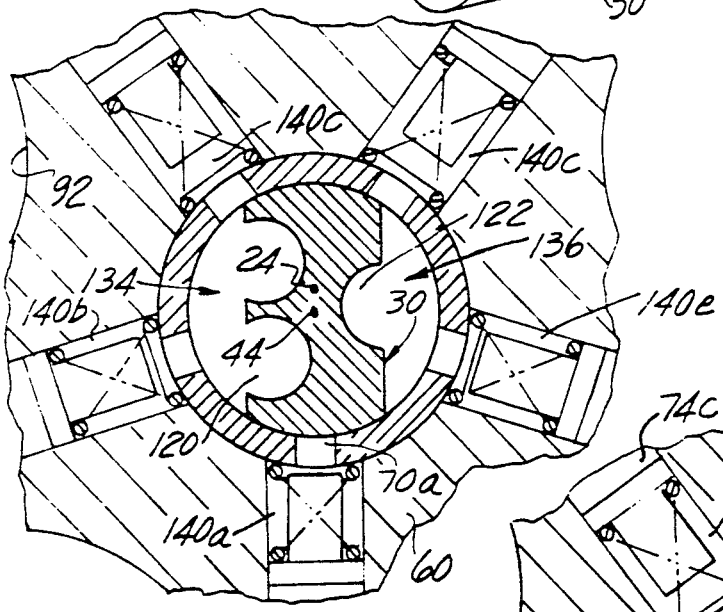
FIG. 6
FIG. 7
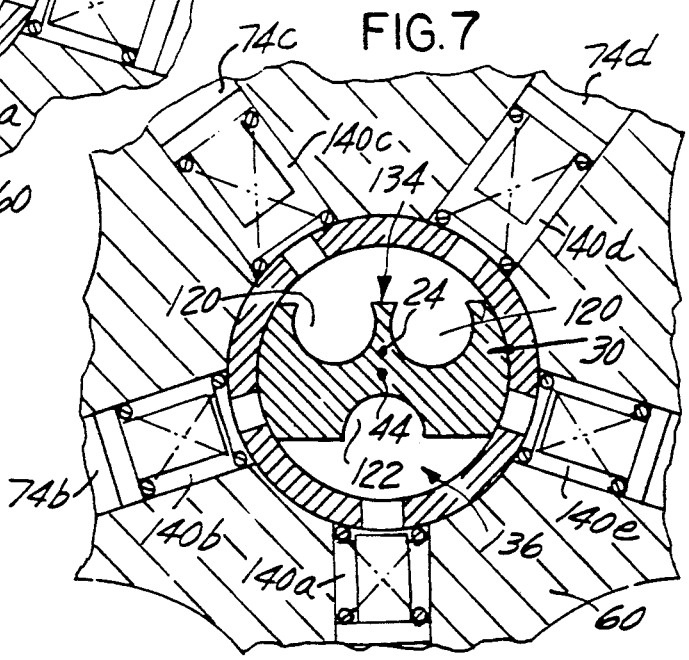

PUMP WITH REVERSE FLOW CAPABILITY AND SYSTEM

This application is a continuation of application Ser. No. 07/622,693 filed Dec. 5, 1990 now abandoned.

BACKGROUND AND SUMMARY OF THE INVENTION

The present invention relates to a pump having reverse flow capability and more particularly to a piston pump having an actuator rotatable ported shaft which when rotated reverses the orientation of flow ports and hence reverses the direction of fluid flow.

It is an object of the present invention to provide a pump having reverse flow capability. A further object of the present invention is to provide a pump in which flow therethrough can be stopped in response to the selective rotation of a ported shaft.

Accordingly, the invention comprises a reversible flow pump comprising: a first port and a second port; a rotor comprising a plurality of pump elements movable through a fill mode and a discharge mode, a pump chamber associated with each pump element which are respectively filled and discharged, and ported shaft means rotatable between a first position and a second position for carrying fluid to and from the various pump chambers, such that when in the first position fluid received at the first port is communicated to fill each pump chamber during the fill mode, at least a portion of such fluid is discharged therefrom and communicated to the second port, and wherein in the second position, fluid received at the second port is communicated to each pump chamber during the fill mode and during the discharge mode at least a portion of such fluid is discharged therefrom and communicated to the first port. Other embodiments of the invention incorporate the pump into a hydraulic brake system.

Many other objects and purposes of the invention will be clear from the following detailed description of the drawings.

BRIEF DESCRIPTION OF THE DRAWINGS

In the drawings:

FIGS. 4 and 5 illustrate the variable porting arrangement accomplished by the present invention.

FIG. 6 shows the pump in an alternate porting arrangement.

FIG. 7 illustrates a no flow or neutral mode of pump operation.

DETAILED DESCRIPTION OF THE DRAWINGS

Figure 1:
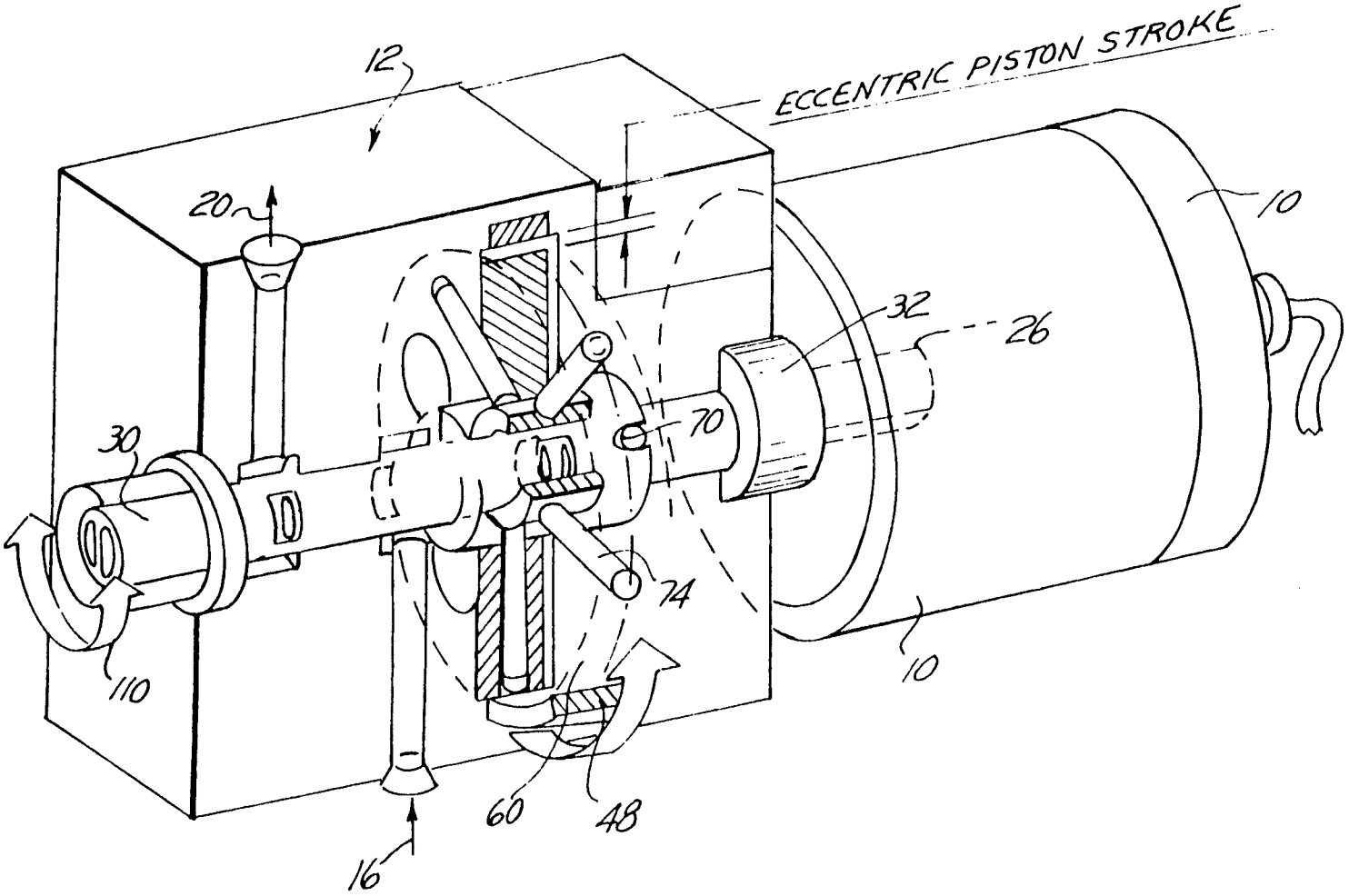
FIG. 1 illustrates a projected view of a motor pump combination in accordance with the present invention.
Figure 2:
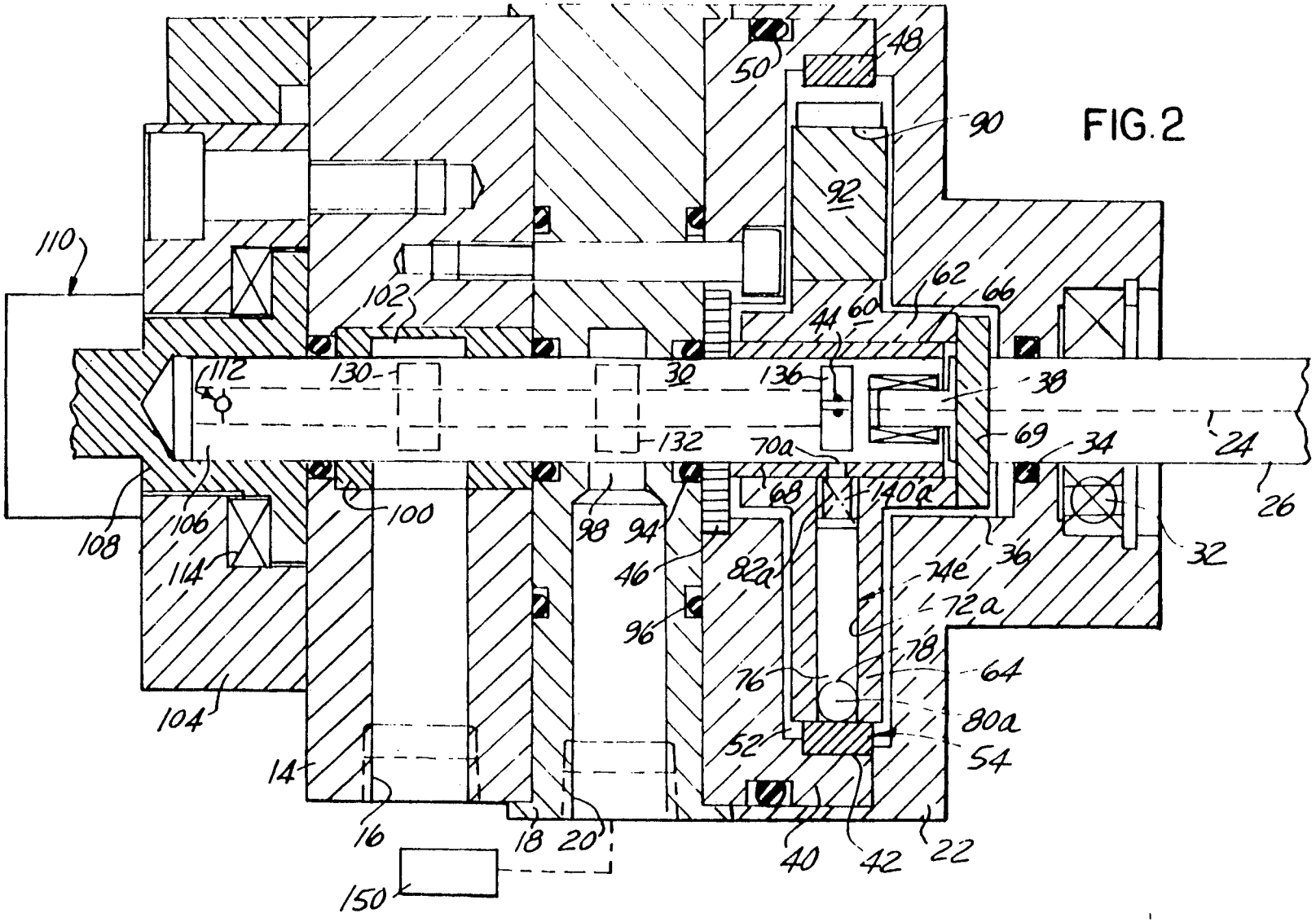
FIG. 2 illustrates a cross-sectional view of the pump.
Figure 3:
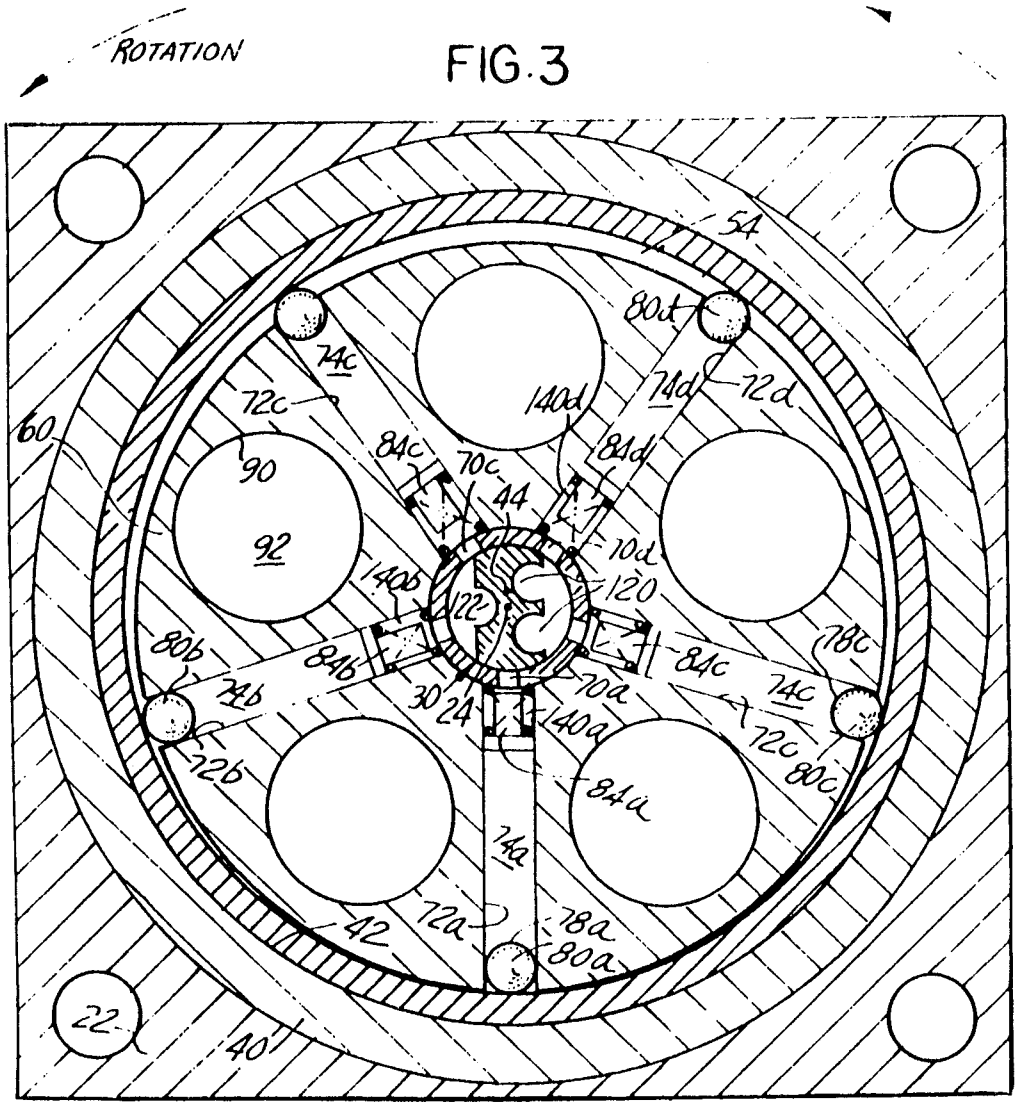
FIG. 3 illustrates another cross-sectional view of the pump.

With reference to FIGS. 1 through 3, there is illustrated an electric motor 10 driving a pump, generally shown as 12. The pump 12 (see FIG. 2) comprises an inlet plate 14 defining a first or inlet port 16, an outlet plate 18 defining a second or outlet port 20, and a cover 22. Extending into the pump and positioned coaxially relative to a first pump axis 24 is a shaft 26 extending from the motor 10. The motor shaft 26 is adapted to drive a rotor generally shown as 60. The motor shaft 26 is supported relative to the cover or plate 22 by ball bearings 32; an O-ring 34 is provided proximate a stepped bore 36 formed in the cover 22 to seal the motor shaft 26. The motor shaft includes a reduced diameter portion 38 which is received within the ported shaft 30 as more specifically described below.

Situated within the cover 22 is a race support 40 defining an annular race support surface 42 which is coaxially disposed about a second axis 44, such second axis being eccentrically positioned relative to the first axis 24 as shown in the figures.

A first bushing 46 is mounted to the race support and supports the ported shaft 30 relative to axis 24. Secured to the race support surface 42 is a race ring 48. Another O-ring 50 provides for a fluid tight seal between the race support 40 and cover 22. The race support further includes another stepped bore 52, which in concert with stepped bore 36 in the cover 22, defines a pump chamber 54.

Concentrically positioned about axis 24 and within the pump chamber 54 is the rotor 60. The rotor 60 comprises a central flanged hub 62 and a radially extending piston support member 64 of integral construction. Situated within a bore central 66, extending through the hub 62, is a hollow, first bushing 68. The bushing 68 includes a plurality of narrowed passages or ports 70*a–c* (shown in FIG. 3). The hub 62 of the rotor 60 is secured to the motor shaft 26 by a pin 69. The rotor 60 includes a plurality of symmetrically arranged piston bores 72*a–e* into which are received a plurality of pistons 74*a–e*. The inner end of each bore 72 defines a portion of a corresponding pump chamber 140. The outer end 76 of each piston is arcuately recessed at 78 for receipt of a respective ball 80*a–e*. Preferably, these recesses 78 are spherically shaped, however, other shapes such as conical are within the spirit of the invention. In the embodiment shown such balls are ball bearings. The balls 80 are biassed into the race 48 by a plurality of springs 82*a–e*, which are received about a narrowed inner end 84*a–e* of each piston 74. As can be seen from FIG. 3, the rotor 60 includes five (5) pistons 74. The odd number of pistons is chosen to reduce even numbered harmonics which contribute to accoustical noise. It should be appreciated, however, that the present invention can be configured with more or less pistons of even or odd number. The rotor 60 further includes a plurality of axial bores or holes 90 which are preferably filled with a nonmagnetic, nonconductive material 92, such as Teflon. Holes 90 permit removal of rotor material which in turn reduces the weight and inertia of the rotor 60. In addition, as the rotor 60 may float in the pump chamber 54, the material 92 extends a few thousandths of an inch beyond the rotor 60 surface to act as a bearing surface against the walls of the pump chamber 54.

Positioned adjacent the race support 40 is the output plate 18. O-rings such as 94 and 96 provide additional sealing. The outlet port 20 extends through the outlet plate 18 to an annular cavity 98 situated about the ported shaft 30. Positioned adjacent the outlet plate 18 is the inlet plate 14 which includes a centrally positioned bushing 100 for supporting another end of the ported shaft 30. The bushing 100 defines another annular cavity 102 about the ported shaft 30. Another cover 104 is mounted to the inlet plate 14. A rotary actuator 110 is secured to the extending end 106 of the ported shaft by an adaptor member 108 pinned to the shaft 30 at 112. A thrust washer 114 is provided to permit axial shaft 30 movement.

Reference is made to the figures and particularly to FIGS. 4 and 5, which illustrate projected views of the ported shaft 30. In these views the rotary actuator is diagramatically shown as a manually adjustable lever connected to the end 106 of the shaft 30. The Ported shaft 30 comprises a hollowed core having a first or inlet passage 120 and a second or outlet passage 122. The ratio of the cross-sectional areas of the inlet to outlet passages is preferably 2:1. As shown in FIGS. 4 and 5, passage 120 may be formed by two bores for ease of manufacture. In these figures the outlet passage is formed by two hollow bores. The end of these passages 120 and 122 proximate the end 106 of the ported shaft are blocked or filled with a plug or the like. However, in FIGS. 4 and 5 these portions of the passages 120 and 122 are shown open for purposes of visualization. The shaft 30 further includes a plurality of cut-outs defining shaft ports. More specifically, the shaft 30 includes a first shaft port 130 in communication with passage 120 and an axially spaced second shaft port 132 in communication with passage 122. Port 132 is positioned approximately 180 degrees apart from port 130. The shaft 30 further includes a pair of oppositely positioned ports 134 and 136 respectively communicated to passages 120 and 122.

The ports 130-136 are positioned along the shaft 30 such that shaft port 130 is in communication with cavity 102, and shaft port 132 is in communication with cavity 98. Fluid communicated to the inlet port 16 enters the annular cavity 102 and flows within the first port 130. The fluid then flows through passage 120 to port 134 filling the pump cavities 140 associated with the pistons 74 which are therein communication with the port 134. Reference is made to FIG. 3, wherein the pump cavities 140*d* and *e* are in a fill mode and are shown in communication with the port 134.

As the rotor 60 is turned by the motor 10, the various pistons 74 and ported bushing 68 (having the ports 70) rotate relative to the race 48. With the ported shaft 30 in the position described and as each piston rotates into communication with port 134, i.e., passage 120 (the inlet stroke), each corresponding pumping chamber 140 is appropriately filled as fluid flows from port 134 through ports 70 (in bushing 68). The fill stroke of each piston 74 terminates as each corresponding bushing port 70 rotates about the ported shaft out of communication with port 134 entrapping fluid in the corresponding pump chamber 140. As can be seen, the eccentric positioning between the race 48 and rotor 60 defines the stroke of the pistons. As the rotor turns and as each piston is moved radially inwardly as the spacing between the rotor 60 and race 48 narrows due to the eccentric positioning, the fluid within each pumping chamber 140 is compressed. The compressed fluid is expelled from the pumping chambers 140 through ports 70 and enters port 136 and flows through passage 122, and into exit port 132 (see FIG. 4) of the ported shaft 30. Recalling that port 132 is in communication with the annular chamber 98, such expelled fluid flows into the outlet port 20 and is discharged to a connected fluidic device 150.

In summary, with the ported shaft 30 in the position as shown, fluid flows from the inlet port 16 through the outlet port 20 and to the fluidic device 150 connected thereto. If during the operation of the pump 12 it is desired to reverse the direction of fluid flow, i.e., to draw fluid from the fluidic device 150, the actuator 110 causes the ported shaft 30 to rotate approximately 180 degrees to a position shown in FIG. 5. In this condition, the orientation and function of ports 134 and 136 is reversed in relation to the motion of the pistons 74, redefining the intake, compression and discharge sequence of the pumping cycle.

As an example, as shown in FIG. 6, with the ported shaft 30 rotated piston chambers such as 140*d* and 140*e* shown in FIG. 3 are now in communication with port 136 to receive fluid from the device 150. Similarly, the other piston chambers 140*c,b*, etc., which previously discharged fluid into the fluidic device 150 can be used to discharge fluid from the fluidic device 150 to a sump connect to the pump inlet 16.

In view of this interchanged porting, fluid resident in the device 150 flows into port 132 (see FIG. 5), through passage 122 into port 136 thereby filling the pumping chambers 140 in communication therewith. This fluid exits the pump as the pistons pressurize the respective pumping chambers 140 causing the fluid to enter port 134, flow within passage 120 and exit through the previously designated inlet port 16 and into a sump (not shown). In this manner, it can be seen that by controlling the position of the ported shaft 30, the direction of fluid flow through a pump and the direction of fluid flow to or from a device such as 150 can be reversed.

An additional feature of the present invention is that the flow rate either into or out of the pump and the corresponding pressure developed by the pump is proportional and depends upon the rotational position of the ported shaft 30. In addition, the ported shaft can be positioned in a manner such that the pump exhibits a zero or no flow condition. This condition is illustrated in FIG. 7 wherein the ported shaft has been rotated to approximately a 90 degree position relative to the position of the ported shaft shown in FIG. 3. While a 90 degree rotation is shown in FIG. 7, the actual rotation may vary somewhat due to the leakage flow about the ported shaft 30. With the ported shaft 30 in the position illustrated in FIG. 7, piston chambers such as 140*c* and 140*d* will be filled with fluid from the inlet passage 120. As the rotor 60 continues to turn, the volume of piston chambers 140*a–d* will increase such as illustrated by the position of piston 74*d* as it is pushed outwardly by its spring 84*d*. Similarly during this interval, a piston in the position of piston 74*c* will be forced inwardly as its stroke reduces thereby pushing fluid back into the inlet passage 120 and thereafter into the expanding piston chamber 140*d* such that an equilibrium condition will exist wherein the net amount of fluid entering the inlet 16 of the pump will be zero. Further, as the rotor 60 continues to rotate the previously filled piston chamber such as chamber 140*c* will be in a position such as the position of the piston 74*b* wherein the volume of its piston chamber has been significantly reduced so that any fluid in such piston chamber is forced into either the inlet passage 120 or the outlet passage 122 or the corresponding ports 134 or 136 by virtue of leakage flow about the ported shaft 30 and thereafter into the piston chamber in the position of the piston chamber 140*e* which is presently expanding therein generating a zero net flow into the outlet port 122.

Figure 8:
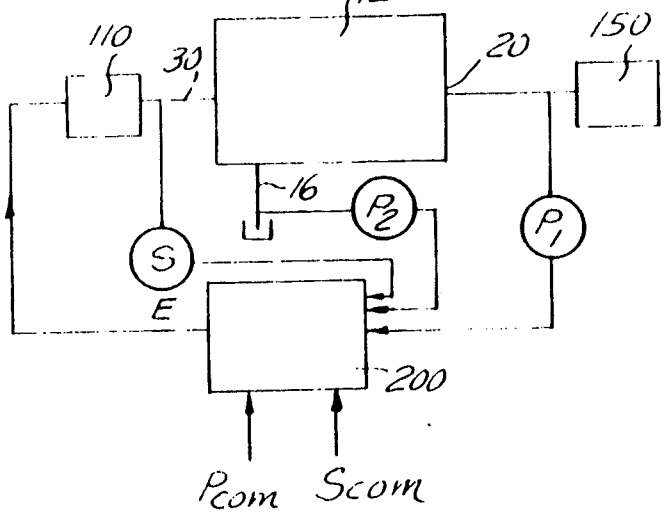
FIG. 8 illustrates an exemplary control system using the pump.
Figure 9:
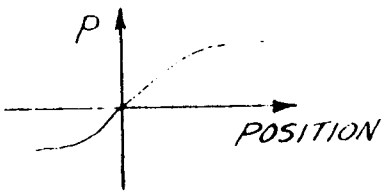
FIG. 9 illustrates a graph showing a system parameter.

Reference is made to FIG. 8 which illustrates an exemplary control system that could be used with the pump 12 to achieve precise control of pump flow and resulting output pressure. More specifically, the outlet 20 of the pump 12 is connected to a fluid device 150 typically having a fluid storage chamber therein. The ported shaft 30 is connected to the rotary actuator 110. If it is desired to control the pressure generated at the outlet 20 of the pump, a first pressure sensor $P_1$ is utilized to sense pump output pressure. The measurement signal generated by the pressure sensor $P_1$ is communicated to an electronic control 200 of known design wherein the measured pressure signal is compared to a pressure command signal $P_{com}$ to generate an error signal generally shown as E, which is communicated to the rotary actuator 110 thereby positioning the ported shaft 30 in a manner to drive the error signal to zero. In view of the above, the outlet pressure generated by the pump 12 can be controlled in a closed loop manner. Similarly, if it is desired to control the pressure generated at the pump inlet, i.e. with the pump 12 in its reverse flow condition, that is with fluid flowing from the device 150 into the pump's sump, an additional pressure sensor $P_2$ can be used to generate an error signal in the manner described above. As an alternative to directly controlling the pressure generated by the pump 12 in the above closed loop manner, the pump pressure can also be controlled by directly controlling the position of the actuator as sensed by a position sensor generally shown as S, which is compared to a position command signal $S_{com}$. With the pump 12 connected as shown in FIG. 8, a calibration of pump pressure versus the position of the shaft 30 can be obtained throught testing or the like. One such relationship is shown in FIG. 9 and is purely for illustrative purposes. This relationship can then be synthesized and stored within the control circuit 200. Based upon the prior calibration of the system it can be seen that by controlling the position of the ported shaft 30 a known pressure will be generated. As such, by comparing the actual position of the ported shaft or alternatively the position of the rotary actuator 110 with the position command signal, the desired output pressure will be achieved.

Figure 10:
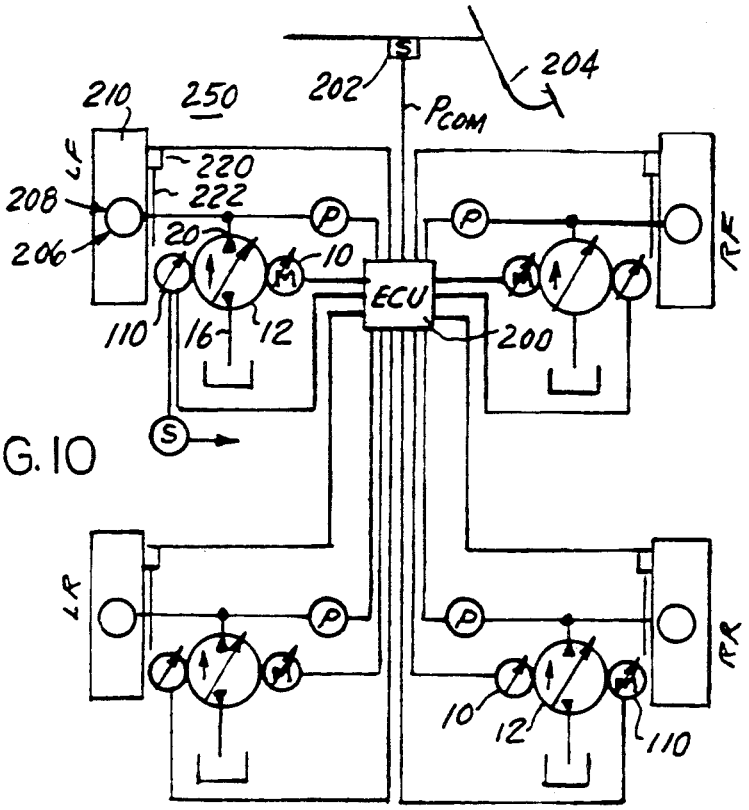
FIGS. 10 and 11 illustrate a brake system for a vehicle.

Reference is made to FIG. 10 which illustrates a brake system 250 incorporating the teachings of the present invention. More specifically, there is illustrated a four wheel braking system under control of a control circuit or ECU 200. A command signal is generated by a pedal force sensor such as 202 connected to a brake pedal 204 activated by the vehicle operator. The output of the force transducer 204 may also be through of as a pressure command signal such as that described with regard to FIG. 8, which may actually be generated by scaling of the force sensor output sensor in the ECU 200, as is known in the art. The ECU 200 generates a command signal to the motor 10 which in turn causes the pump 12 to rotate. The output port 20 of pump 12 feeds a brake cylinder 206 of a hydraulic brake 208 which may be a disk brake or drum brake. The pressure developed within the brake cylinder 206 is measured by a pressure sensor, P, the output of which is communicated to the ECU 200 and compared to the commanded pressure signal as more specifically described in FIG. 8. The ECU also generates an actuation signal to the actuator 110 causing same to rotate in a manner that the pressure developed within the brake cylinder 206 corresponds to the command pressure. A position sensor shown as S is used to monitor the position of the actuator 110, the output of which is communicated to the ECU 200. As shown in FIG. 10, the brake system comprises four (4) motor/pump actuator combinations for each of the wheels 210 of the vehicle. The arrangement of components and sensors for the remaining three wheels of the vehicle, right front (RF), left rear (LR), and right rear (RR), is identical to that described for the left front wheel (LF). With regard to the rear wheels of the vehicle, the corresponding actuators 110 will be controlled in the manner described above to obtain a pressure in the rear wheels which is a scaled down percentage of those in the front wheels to provide the desired front-to-rear brake distribution as is often done in the art. In the system 250 the scaling is done electrically, while many prior art brake systems use a mechanical proportioning valve.

The system 200 can operate in an antilock mode of operation as well as in the above-described service brake mode of operation. Each of the various wheels 210 of the vehicle is equipped with a wheel speed sensor 220 and a corresponding tone wheel 222 rotatably mounted to the wheel 210. The output of each wheel speed sensor 220 is communicated to the ECU 200. Various techniques can be used which utilize the output of wheel speed sensors to determine whether or not any particular wheel is in a skidding or impending skid condition. One such technique is shown in the commonly owned patent application U.S. Ser. No. 07/692,104 which is incorporated herein by reference. When such a wheel or wheels is in a skidding or impending skid condition, the brake pressure applied to the wheel cylinder such as 206 of the skidding wheel is reduced to permit the wheel to reaccelerate and thereafter the pressure may be increased or held at predetermined levels until the skidding wheel's rotational behavior is controlled or until the vehicle is brought to a stop. As such, when the ECU 200 determines that any particular wheel or wheels is in a skidding condition, based upon information from the wheel speed sensors 220, it will control the actuator 110 to decrease, increase and selectively hold the pressure at the particular wheel cylinder 206 to control the rotational behavior of the skidding wheel 210.

Figure 11:
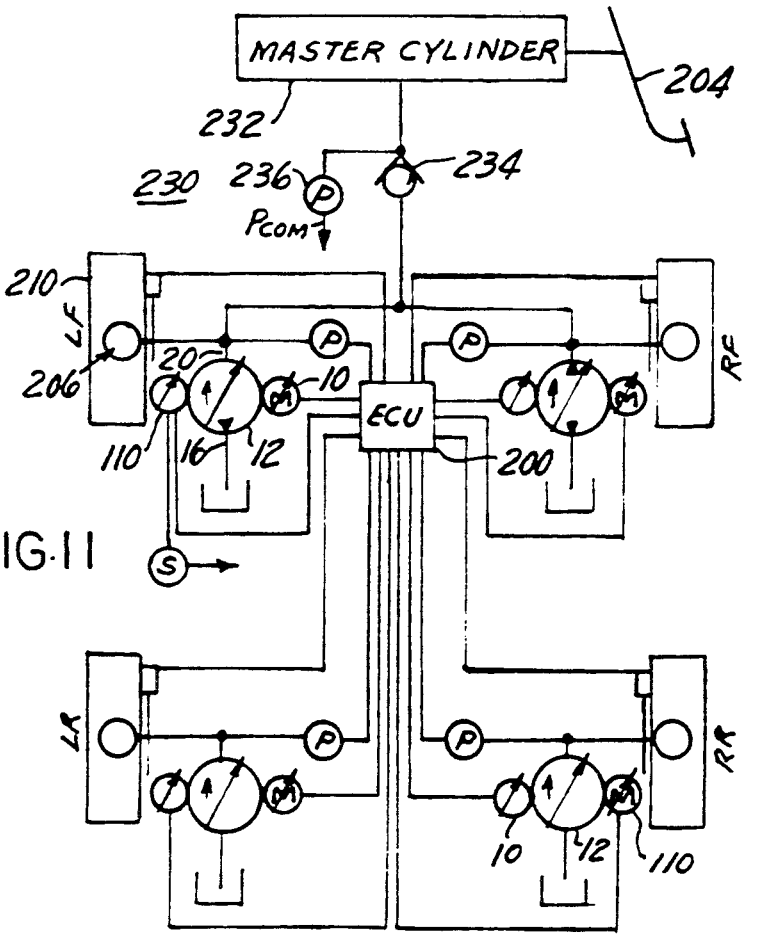

Reference is made to FIG. 11 which illustrates an alternate brake control system 230 which in its construction is identical to system 250 with the exception of replacing the brake force sensor 202 with a master cylinder 232, isolation valve 234 and pressure sensor 236 which monitors the pressure generated within the master cylinder and communicates same to the ECU 200. The primary purpose of utilizing the master cylinder is to provide a failsafe mode of operation in the event of a malfunction of the motor 10, pump 20, or actuator 110 associated with the front wheels of the vehicle. As illustrated, the valve 234 is a check valve, however, an alternate known differential pressure isolation valve or an electrically operated isolation valve responsive from a signal from the ECU 200 can also be used. Initially upon application of the brake pedal 204 the master cylinder will increase the brake pressure to the front brake cylinders 206 until such time as the pressure generated by the pump 12 at the various ports 20 is equal to or greater than the pressure generated in the master cylinder. At such time, the isolation valve 234 will close thereby isolating the master cylinder from the brake cylinders. Subsequently, the brake pressure developed in each brake cylinder 206 is controlled by the ECU in response to the pressure command signal generated by sensor 236.

Many changes and modifications in the above described embodiment of the invention can, of course, be carried out without departing from the scope thereof. Accordingly, that scope is intended to be limited only by the scope of the appended claims.

We claim:

1. A reversible, variable flow pump (12) comprising:
a first port (16) and a second port (20);
a rotor (60) comprising a plurality of pump elements (74–80) movable through a fill mode and a discharge mode, a pump chamber (140) associated with each pump element (74) which is respectively filled and discharged,
ported shaft means (30) rotatable between a first position and a second position, for carrying fluid to and from the various pump chambers (140), such that when in the first position fluid received at the first port (16) is communicated to selectively fill each pump chamber (140) during the fill mode, at least a portion of such fluid is discharged therefrom and communicated to the second port (20), and wherein in the second position fluid received at the second port (20) is selectively communicated to each pump chamber (140) during the fill mode and during the discharge mode at least a portion of such fluid is discharged therefrom and communicated to the first port (16).

2. The pump (12) as defined in claim 1 wherein the ported shaft means (30) includes a first passage (120), communicated to the first port (16), a first shaft port (130) communicated to the first passage (120), a second shaft port (134) communicated to the first shaft port (130) and to certain ones of the pump chambers (140) as the rotor (60) turns, a third shaft port (132) communicated to the second port (20) and a fourth shaft port (136) communicated through a second passage (122) to the third shaft port (132) and to certain other ones of the pump chambers (140).

3. The pump (12) as defined in claim 2 including actuator means for (110) for moving the ported shaft means (30) between the first and second positions.

4. The pump (12) as defined in claim 1 including a motor (10) for powering the rotor (60).

5. The pump (12) as defined in claim 2 wherein the first and second passages are axially disposed through portions of the ported shaft (30).

6. The pump (12) as defined in claim 1 including a race (48) and wherein the rotor (60) is eccentrically position relative to a race (48) and wherein each pumping element (74–80) comprises a piston (74) radially movable within the rotor (60) and orbitally movable relative to the race (48).

7. The pump (12) as defined in claim 6 wherein each piston (74) comprises a arcuately shaped end (76), and a ball (80) loosely received in such end, a spring (84) received with a corresponding pump chamber (140) for biasing the ball (80) into the race (48).

8. The pump (12) as defined in claim 7 wherein the eccentric positioning defines the radial movement or stroke of each piston (74) and wherein the stroke is less than or equal to the radius of the ball (80).

9. The pump (12) as defined in claim 5 wherein the ratio of flow areas of the first passage (120) and second passage (122) are approximately 2:1.

10. The pump (12) as defined in claim 2 further comprising a first annular cavity (102) in communication with the first port (16) and disposed about the first shaft port (134) and a second annular cavity (98) in communication with the second port (20) and disposed about the third shaft port (132).

11. The pump (12) as defined in claim 3 wherein the actuator means (110) includes one of a rotary solenoid, torque motor and d.c. motor movable between the first and second positions.

12. The pump (12) as defined in claim 11 wherein the first and second positions are 180 degrees apart.

13. The pump as defined in claim 2 wherein the second shaft port (134) and the fourth shaft port (136) are 180 degrees apart about the ported shaft (30).

14. The pump (12) as defined in claim 1 wherein with the ported shaft (30) positioned at an intermediate position between the first and second positions a flow equilibrium condition is established wherein the net flow out of the pump is zero.

15. The pump (12) as defined in claim 1 wherein such pump is connected in circuit with a control circuit (200), such circuit including means for measuring the pressure developed at either of the first port and the second port (20) and first means for generating an error signal between a commanded parameter and the measured parameter and wherein the actuator means (110) is responsive to the error signal to move the ported shaft (30) in a manner to drive the error signal to zero thereby controlling the pressure developed by the pump.

16. A brake system (230;250) comprising:
a reversible, variable flow pump (12) comprising:
a first port (16) and a second port (20);
a rotor (60) comprising a plurality of pump elements (74–80) movable through a fill mode and a discharge mode, a pump chamber (140) associated with each pump element (74) which is respectively filled and discharged,
ported shaft means (30) rotatable between a first position and a second position, for carrying fluid to and from the various pump chambers (140), such that when in the first position fluid received at the first port (16) is communicated to selectively fill each pump chamber (140) during the fill mode, at least a portion of such fluid is discharged therefrom and communicated to the second port (20), and wherein in the second position fluid received at the second port (20) is selectively communicated to each pump chamber (140) during the fill mode and during the discharge mode at least a portion of such fluid is discharged therefrom and communicated to the first port (16), wherein with the ported shaft (30) positioned at an intermediate position between the first and second positions a flow equilibrium condition is established wherein the net flow out of the pump is zero;
actuator means (110) for rotating the ported shaft to the first, second and intermediate positions;
control means (200) for generating a signal to control the actuator means causing same to rotate to the various positions to effect an increase, reduction or holding of the brake pressure in the brake cylinder.

17. The brake system as defined in claim 16 including a master cylinder (232) communicated to the second port (20) for actuating the brake cylinder during periods when the pressure developed by the master cylinder is greater than the pressure developed by the pump (12).

18. The system as defined in claim 16 wherein the control means includes first means for determining whether or not a wheel (210) associated with the brake is skidding or in an impending skid condition and for causing the actuator means to to rapidly rotate the ported shaft through its various positions to increase, decrease and when necessary hold the pressure developed by the pump (12) to permit the wheel to come out of the skid condition.

* * * * *